US011328741B2

(12) United States Patent
Kotulla

(10) Patent No.: US 11,328,741 B2
(45) Date of Patent: May 10, 2022

(54) METHOD FOR OUTPUTTING AN AUDIO SIGNAL REPRODUCING A PIECE OF MUSIC INTO AN INTERIOR VIA AN OUTPUT DEVICE

(71) Applicant: ASK INDUSTRIES GMBH, Niederwinkling (DE)

(72) Inventor: Daniel Kotulla, Mitterfels (DE)

(73) Assignee: ASK INDUSTRIES GMBH, Niederwinkling (DE)

( * ) Notice: Subject to any disclaimer, the term of this patent is extended or adjusted under 35 U.S.C. 154(b) by 0 days.

(21) Appl. No.: 16/962,987

(22) PCT Filed: Jan. 18, 2018

(86) PCT No.: PCT/EP2018/051242
§ 371 (c)(1),
(2) Date: Aug. 26, 2020

(87) PCT Pub. No.: WO2019/141368
PCT Pub. Date: Jul. 25, 2019

(65) Prior Publication Data

US 2021/0249037 A1 Aug. 12, 2021

(51) Int. Cl.

| | |
|---|---|
| ***G10L 25/81*** | (2013.01) |
| ***G10L 25/48*** | (2013.01) |
| ***H04R 5/04*** | (2006.01) |

(52) U.S. Cl.
CPC ..... *G10L 25/81* (2013.01); *G10L 25/48* (2013.01); *H04R 5/04* (2013.01); *H04R 2430/01* (2013.01);
(Continued)

(58) Field of Classification Search
CPC ..... G10L 25/81; G10L 25/48; G10L 21/0272; H04R 5/04; H04R 3/00; H04R 2430/01;
(Continued)

(56) References Cited

U.S. PATENT DOCUMENTS 4,953,212 A * 8/1990 Otsubo ..... G10H 1/361 369/86
6,405,163 B1 * 6/2002 Laroche ..... H04S 3/008 381/2

(Continued)

FOREIGN PATENT DOCUMENTS

| | | | |
|---|---|---|---|
| DE | 102012025016 | 5/2014 | |
| WO | WO2006/037197 | 4/2006 | |
| WO | WO-2006037197 A2 * | 4/2006 | ..... G10H 1/361 |

OTHER PUBLICATIONS

International Search Report issued in International Patent Application No. PCT/EP2018/051242, dated Jul. 10, 2018 (along with English translation).

(Continued)

*Primary Examiner* — Yogeshkumar Patel
(74) *Attorney, Agent, or Firm* — Greenblum & Bernstein, P.L.C.

(57) ABSTRACT

Method for outputting an audio signal reproducing at least part of a piece of music containing part of at least one main voice, in particular a singing voice, into an interior forming part of a passenger compartment of a motor vehicle via an audio output device having a left and a right audio output channel. The method includes providing an audio signal reproducing at least part of a piece of music containing at least one main voice, extracting an audio signal component, containing the at least one main voice, of the audio signal from the audio signal, attenuating the audio signal component containing the at least one main voice, and outputting the audio signal via the left and right audio output channels, of the audio output device, wherein the audio signal component containing the at least one main voice is output in attenuated fashion.

16 Claims, 1 Drawing Sheet

(52) U.S. Cl.
CPC ..... *H04R 2430/03* (2013.01); *H04R 2499/13* (2013.01)

(58) Field of Classification Search
CPC ..... H04R 2430/03; H04R 2499/13; H04R 2420/01; G10H 1/361; G10H 2210/305; H04S 5/005; H04S 5/00; H04S 7/00; H04S 1/007; H04S 3/008; H04S 2400/05; H04S 2430/03
See application file for complete search history.

(56) References Cited

U.S. PATENT DOCUMENTS

| | | | | |
|---|---|---|---|---|
| 2011/0038485 | A1* | 2/2011 | Neoran ..... | H04S 5/00 381/27 |
| 2012/0114142 | A1 | 5/2012 | Nishigori et al. | |

OTHER PUBLICATIONS

Written Opinion issued in International Patent Application No. PCT/EP2018/051242, dated Jul. 10, 2018.

* cited by examiner

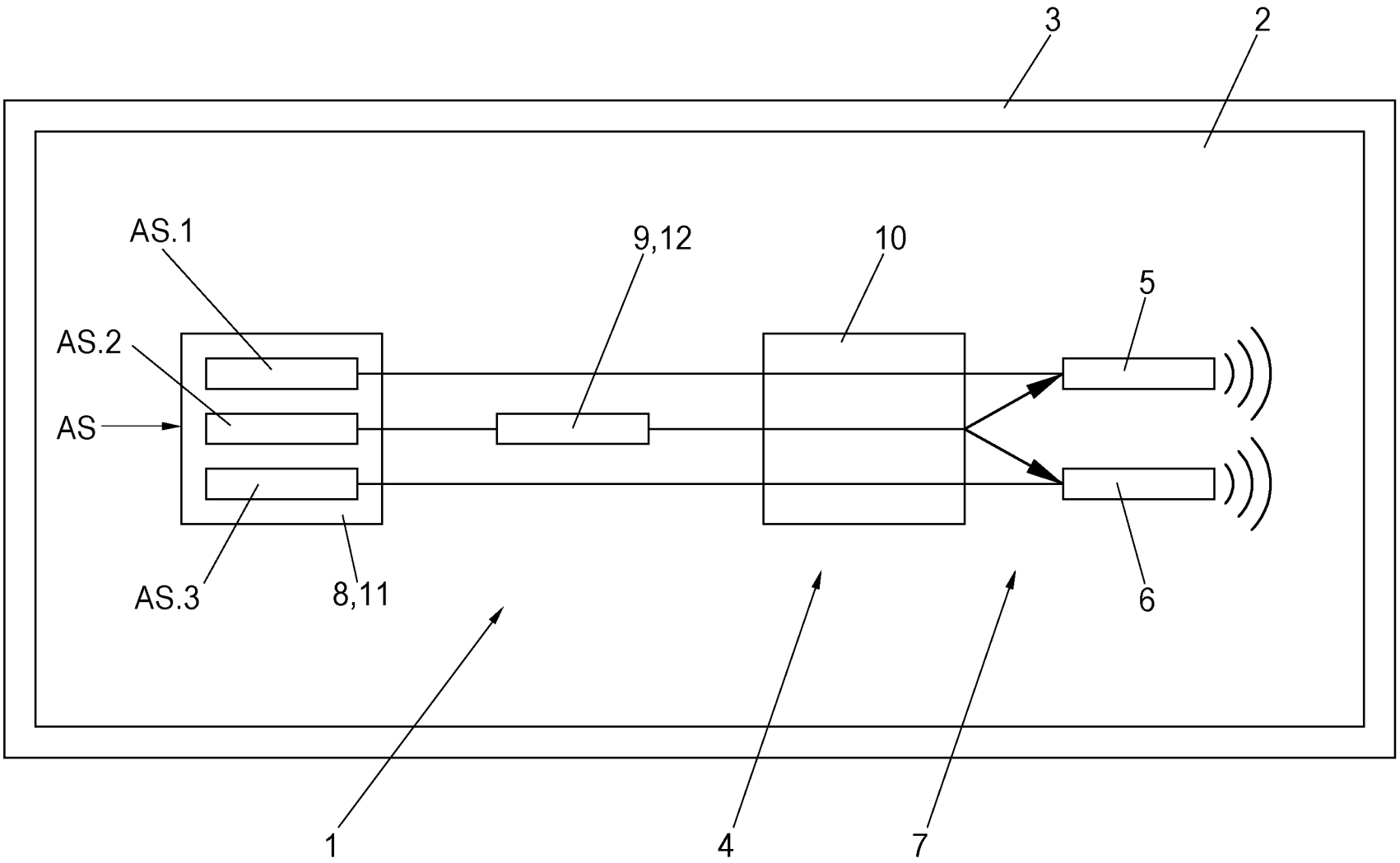
2
3
5
6
7
10
4
9,12
1
8,11
AS.1
AS.2
AS
AS.3

METHOD FOR OUTPUTTING AN AUDIO SIGNAL REPRODUCING A PIECE OF MUSIC INTO AN INTERIOR VIA AN OUTPUT DEVICE

The invention relates to a method for outputting an audio signal that reproduces at least part of a piece of music containing at least one main voice, in particular a singing voice, into at least one interior forming part of a passenger compartment of a motor vehicle via an audio-output apparatus comprising a left and a right audio-output channel.

Corresponding methods for outputting an audio signal that reproduces at least part of a piece of music containing at least one main voice, in particular a singing voice, into at least one interior forming part of a passenger compartment of a motor vehicle via an audio-output apparatus comprising a left and a right audio-output channel are known in principle and are implemented in modern motor vehicles by means of audio-output apparatuses configured with appropriate hardware and/or software.

In certain situations, it may be desirable to at least temporarily attenuate or (completely) block out the audio-signal component of an audio signal reproducing a piece of music that reproduces a main voice, i.e. typically a singing voice. It may e.g. be desirable to at least temporarily attenuate or block out the audio-signal component that reproduces the main voice in order to improve the perception of other acoustic features in a certain acoustic situation; for example, by accordingly attenuating or blocking out the audio-signal component that reproduces the main voice, the acoustic perception of speech, i.e. a conversation, for example, within the passenger compartment can be improved. Furthermore, it may be desirable to at least temporarily attenuate or block out the audio-signal component that reproduces the main voice in order to implement a karaoke playback mode.

Previous technical approaches for at least temporarily attenuating or blocking out the audio-signal component of an audio signal to be output that contains a main voice are routinely technically complex, in particular with regard to the hardware and/or software resources required for this purpose.

The problem addressed by the invention is to provide an improved method for outputting an audio signal that reproduces at least part of a piece of music containing at least one main voice, in particular a singing voice, into at least one interior forming part of a passenger compartment of a motor vehicle via an audio-output apparatus comprising a left and a right audio-output channel.

The problem is solved by a method according to claim 1. The claims that are dependent thereon relate to possible embodiments of the method.

The method described herein serves to output at least one audio signal into at least one interior forming part of a passenger compartment of a motor vehicle via an audio-output apparatus comprising a left and a right audio-output channel. The audio signal that is or can be output according to the method reproduces at least part of a piece of music containing at least one main voice, i.e. typically a (human) singing voice. The audio signal that is or can be output according to the method is therefore a piece of music containing a main voice; the audio signal can therefore be described as or considered to be a music signal.

The audio signal typically contains a plurality of audio-signal components, which can be differentiated from one another e.g. by amplitude and/or frequency or by corresponding amplitude curves and/or frequency curves. Here, at least one audio-signal component contains the main voice, i.e. typically a singing voice, of the piece of music acoustically reproduced by the audio signal. The audio-signal component containing the main voice differs from the other or remaining audio-signal components of the audio signal e.g. on account of its amplitude and/or frequency or its amplitude curve and/or frequency curve. In addition to the audio-signal component containing the main voice, as mentioned, the audio signal contains additional audio-signal components; such an additional audio-signal component may for example contain: at least one accompanying voice, which is secondary to the main voice, or at least one musical instrument, i.e., for example, a harmony instrument, which may e.g. be a guitar, depending on the type of the piece of music, or a rhythm instrument, which may e.g. be a percussion instrument, depending on the type of the piece of music, or a beat, other sounds, etc. The number and type of the audio-signal components of the audio signal are therefore determined in particular by the type of the piece of music, i.e. whether this is a piece of music from the pop-music genre or a piece of music from the classical-music genre.

The audio signal that is or can be output according to the method is, as mentioned, output into an interior forming part of a passenger compartment of a motor vehicle via an audio-output apparatus. The audio-output apparatus comprises a left and a right audio-output channel; each audio-output channel is typically formed by or at least comprises a speaker. The audio-output apparatus is typically installed in the motor vehicle. The two audio-output channels of the audio-output apparatus are therefore typically arranged in a passenger compartment of a motor vehicle, and therefore the signals that can be output thereby can be output into the passenger compartment of the motor vehicle.

The aim of the method described herein is to at least temporarily attenuate or (completely) block out the audio-signal component containing a main voice in a comparatively simple manner, in particular with regard to the hardware and/or software resources required for this purpose. To do this, the method provides the following steps:

In a first step of the method, an audio signal that reproduces at least part of a piece of music containing at least one main voice is provided. The audio signal is typically a stereo signal. The audio signal can be provided in various ways. For example, the audio signal can be provided via a sound storage medium, i.e. a CD, for example, an optionally portable data storage medium, i.e. hard-disk storage, a USB stick, etc., or a global or local data network, i.e. the Internet, for example, or a global or local data connection, such as a Bluetooth connection, for example.

In a second step of the method, a or the audio-signal component containing the at least one main voice is extracted from the audio signal. The extraction serves to identify the audio-signal component containing the at least one main voice within the audio signal and to separate out the audio-signal component containing the at least one main voice from the audio signal. The audio-signal component containing the at least one main voice is extracted e.g. by means of a hardware-implemented and/or software-implemented extraction apparatus, which is configured to extract an audio-signal component, containing the at least one main voice, of an audio signal reproducing a piece of music containing at least one main voice from the audio signal; a corresponding extraction apparatus can form a functional component of a device configured to carry out the method.

In a third step of the method, the audio-signal component containing the at least one main voice obtained by extraction is attenuated. The audio-signal component containing the at least one main voice obtained by corresponding extraction is attenuated in particular by reducing the dynamics or volume of the audio-signal component containing the at least one main voice; here, this may be both the absolute dynamics or volume of the audio-signal component containing the at least one main voice and the relative dynamics or volume of the audio-signal component containing the at least one main voice, i.e. the dynamics or volume of the audio-signal component containing the at least one main voice in comparison with other or remaining audio-signal components of the audio signal. The audio-signal component containing the at least one main voice can also be completely blocked out by corresponding attenuation; the audio-signal component containing the at least one main voice can therefore be attenuated by the audio-signal component containing the at least one main voice being completely removed from the audio signal, i.e. it can be attenuated to "zero". The audio-signal component containing the at least one main voice is attenuated e.g. by means of a hardware-implemented and/or software-implemented attenuating apparatus, which is configured to attenuate the audio-signal component containing the at least one main voice; a corresponding attenuating apparatus can form a functional component of a device configured to carry out the method.

In a fourth step of the method, the audio signal is output over the left and the right audio-output channel of the audio-output apparatus, wherein the audio-signal component containing the at least one main voice is accordingly output in an attenuated manner, or is not output because it has been blocked out. As a result, it is possible for a vehicle occupant (as mentioned, the audio signal is typically output into an interior forming part of a passenger compartment of a motor vehicle) to hear or acoustically perceive the piece of music in question with an attenuated or blocked-out audio-signal component containing the at least one main voice, i.e. with an attenuated or blocked-out main voice, in a technically simple manner, in particular with regard to the hardware and/or software resources required for this purpose.

The audio-signal component containing the at least one main voice can be extracted by splitting the provided audio signal into a plurality of audio-signal components, one audio-signal component obtained by splitting the audio signal containing the at least one main voice. The audio signal can therefore be split into a plurality of audio-signal components, one audio-signal component containing the at least one main voice. To do this, the audio signal is analysed at least with respect to the audio-signal component containing the at least one main voice using suitable analysis apparatuses or algorithms and is split accordingly. The analysis of the audio signal can be based on certain predefinable or predefined acoustic properties, i.e., for example, amplitude(s) and/or frequency/frequencies of audio-signal components containing main voices which are stored in a storage apparatus (data storage means), for example. The audio signal can therefore be analysed e.g. by comparing predefinable or predefined acoustic properties, i.e., for example, amplitude(s) and/or frequency/frequencies of audio-signal components containing main voices with the audio signal. As will become clear in the following, the audio signal can also be split, with a centre audio-signal component being obtained, which typically contains the at least one main voice. The provided audio signal can be split into a plurality of audio-signal components by a splitting apparatus which is configured to split the provided audio signal into a plurality of audio-signal components; a corresponding splitting apparatus can form a functional component of a device configured to carry out the method.

As mentioned, the provided audio signal can be split such that a centre audio-signal component is obtained. The provided audio signal can in particular be split into a centre audio-signal component, a left audio-signal component, which is in particular perceived by the listener to the left of the main voice or the centre audio-signal component, and a right audio-signal component, which is in particular perceived by the listener to the right of the main voice or the centre audio-signal component. The centre audio-signal component is the audio-signal component which corresponds to an output direction or position that is centrally perceived by a listener when the audio signal is output by an audio-output apparatus comprising two audio-output channels, a left audio-signal component is the audio-signal component which corresponds to an output direction or position that is perceived (more) to the left (compared with a centre audio-signal component) by a listener when the audio signal is output by an audio-output apparatus comprising two audio-output channels, and a right audio-signal component is the audio-signal component which corresponds to an output direction or position that is perceived (more) to the right (compared with a centre audio-signal component) by a listener when the audio signal is output by an audio-output apparatus comprising two audio-output channels.

The splitting of the audio signal carried out by means of suitable splitting apparatuses or algorithms can therefore provide (exactly) three audio-signal components according to the method; therefore, according to the method, the audio signal can be split into (exactly) three audio-signal components, namely a left audio-signal component, which contains all or only components of the audio signal which are perceived to the left of the centre of the output or which are located to the left of the centre of the output, a right audio-signal component, which contains all or only components of the audio signal which are perceived to the right of the centre of the output or which are located to the right of the centre of the output, and a centre audio-signal component, which contains all or only components of the audio signal which are perceived in the centre of the output or which are located in the centre of the output.

By studying various audio signals and/or pieces of music, it has been found that the centre audio-signal component typically contains the at least one main voice; by obtaining the centre audio-signal component, which is done by accordingly splitting the audio signal, the audio-signal component containing the at least one main voice can therefore typically be obtained.

Each audio-signal component obtained from splitting the audio signal can in principle be mixed onto a particular audio-output channel of the audio-output apparatus or output over a particular audio-output channel of the audio-output apparatus. In other words, each audio-signal component can be allocated to one of the two audio-output channels of the audio-output apparatus, via which the relevant audio-signal component is then output. The left and right audio-signal components are typically mixed onto the right and/or the left audio-output channel of the audio-output apparatus in the context of outputting the audio signal; typically, the left audio-signal component is output over the left audio-output channel of the audio-output apparatus and the right audio-signal component is output over the right audio-output channel of the audio-output apparatus in the context of outputting the audio signal. It holds for the centre audio-signal component, which typically contains the at least one main voice, as mentioned, that, depending on the degree of attenuation or blocking out, said component may be mixed onto or output over one or both audio-output channels, e.g. so as to be split by component in an attenuated manner, or may not be mixed or output so as to be (completely) blocked out.

The provided audio signal can be split into respective audio-signal components by means of a source-separation apparatus. A corresponding source-separation apparatus can be implemented by a source-separation algorithm, for example. A suitable method for source separation or a suitable source-separation algorithm is described in German patent DE 10 2012 025 016 B3, for example, with reference being explicitly made to the disclosure thereof.

The audio-signal component, i.e. the centre audio-signal component, for example, containing the at least one main voice can in particular be attenuated by the audio-signal component being filtered out of the audio signal by means of a filter apparatus, in particular a stop filter apparatus, preferably a band-stop filter apparatus. A filter apparatus comprising an upper and a lower cut-off frequency can be used here. The upper and the lower cut-off frequency of the filter apparatus can be selected such that frequency components of the main voice to be filtered out are filtered out. A filter apparatus can therefore be used which is configured to filter out frequency components of the main voice to be filtered out on the basis of corresponding upper and lower cut-off frequencies.

In addition to the method, the invention also relates to a device for outputting an audio signal that reproduces at least part of a piece of music containing at least one main voice, in particular a singing voice, into an interior forming part of a passenger compartment of a motor vehicle via an audio-output apparatus comprising a left and a right audio-output channel, in particular according to the method described herein. The device comprises:

- an extraction apparatus, which is configured to extract an audio-signal component, containing the at least one main voice, of an audio signal reproducing a piece of music containing at least one main voice from the audio signal,
- an attenuating apparatus, which is configured to attenuate the audio-signal component containing the at least one main voice,
- an audio-output apparatus comprising two audio-output channels, which is configured to output the audio signal over the left and the right audio-output channel of the audio-output apparatus, wherein the audio-signal component of the audio signal containing the at least one main voice is output in an attenuated manner.

The device is configured to carry out the method described herein; all the embodiments relating to the method described herein apply by analogy to the device.

The extraction apparatus can therefore be configured for splitting a provided audio signal into a plurality of acoustic audio-signal components, one audio-signal component obtained by splitting the audio signal containing the at least one main voice.

The attenuating apparatus may be designed as or at least comprise a filter apparatus, in particular a stop filter apparatus, preferably a band-stop filter apparatus.

The filter apparatus may comprise an upper and a lower cut-off frequency, the upper and the lower cut-off frequency being selected such that frequency components of the main voice to be filtered out are filtered out.

With regard to the implementation of a karaoke mode, the device may also comprise an output apparatus that is in particular designed as or comprises a display apparatus, i.e. a display, for example, in order to output text information. Text information can be output at the same time as the audio signal is output. The text information may be the text which the attenuated or blocked-out main voice contains or would contain.

In addition to the method and the device, the invention also relates to a motor vehicle, in particular a passenger car, which comprises a corresponding device. Therefore, all the embodiments relating to the method and device described herein apply by analogy to the motor vehicle.

The invention is explained in greater detail on the basis of an embodiment in the FIGURES of the drawings, in which: The single FIGURE shows a schematic diagram of a device according to an embodiment.

The single FIGURE shows a schematic diagram of a device 1 according to an embodiment. The device 1 is configured for outputting an audio signal AS that reproduces at least part of a piece of music containing at least one main voice, in particular a singing voice, into an interior 4 forming part of a passenger compartment 2 of a motor vehicle 3 via an audio-output apparatus 7 comprising a left audio-output channel 5 and a right audio-output channel 6.

The device 1 comprises, as functional components, at least one hardware-implemented and/or software-implemented extraction apparatus 8, one hardware-implemented and/or software-implemented attenuating apparatus 9, one hardware-implemented and/or software-implemented mixing apparatus 10 and the output apparatus 7 comprising the left and the right audio-output channel 5, 6 (speaker). The extraction apparatus 8 is configured to extract an audio-signal component AS.2, containing the at least one main voice, of an audio signal AS reproducing a piece of music containing at least one main voice from the audio signal AS. The attenuating apparatus 9 is configured to attenuate the audio-signal component AS.2 containing the at least one main voice. The mixing apparatus 10 is configured to mix respective audio-signal components AS.1-AS.3 obtained by extraction onto the audio-output channels 5, 6 of the audio-output apparatus 7. The functional interaction between the above-mentioned functional components of the device 1 is described in greater detail in conjunction with the following explanation of the method that can be implemented by the device 1.

With regard to the implementation of a karaoke mode, the device 1 may also comprise an output apparatus (not shown) that is in particular designed as or comprises a display apparatus, i.e. a display, for example, in order to output text information. Text information can be output at the same time as the audio signal AS is output. The text information may be the text which the attenuated or blocked-out main voice contains or would contain.

The device 1 is configured for carrying out a method for outputting an audio signal AS into an interior 4 forming part of a passenger compartment 2 of a motor vehicle 3 via an audio-output apparatus 7 comprising a left and a right audio-output channel 5, 6. The audio signal AS that is or can be output according to the method reproduces part of a piece of music containing at least one main voice, i.e. typically a (human) singing voice. The audio signal AS is therefore a piece of music containing a main voice; the audio signal AS can therefore be described as or considered to be a music signal.

The audio signal AS contains a plurality of audio-signal components AS.1-AS.3, which can be differentiated from one another e.g. by amplitude and/or frequency or by corresponding amplitude curves and/or frequency curves. Here, at least one audio-signal component AS.2 contains the main voice, i.e. typically a singing voice, of the piece of music acoustically reproduced by the audio signal AS. In addition to the audio-signal component AS.2 containing the main voice, the audio signal AS contains additional audio-signal components AS.1, AS.3, namely, for example: at least one accompanying voice, which is secondary to the main voice, or at least one musical instrument, i.e., for example, a harmony instrument, which may e.g. be a guitar, depending on the type of the piece of music, or a rhythm instrument, which may e.g. be a percussion instrument, depending on the type of the piece of music, or a beat, other sounds, etc. The number and type of the audio-signal components AS.1-AS.3 of the audio signal AS are therefore determined in particular by the type of the piece of music, i.e. whether this is a piece of music from the pop-music genre or a piece of music from the classical-music genre.

The aim of the method is to at least temporarily attenuate or (completely) block out the audio-signal component AS.2 containing a main voice in a comparatively simple manner, in particular with regard to the hardware and/or software resources required for this purpose. To do this, the method provides the following steps:

In a first step of the method, an audio signal AS that reproduces a piece of music containing a main voice is provided. The audio signal AS is a stereo signal. The audio signal AS can be provided in various ways. For example, the audio signal AS can be provided via a sound storage medium, i.e. a CD, for example, an optionally portable data storage medium, i.e. hard-disk storage, a USB stick, etc., or a global or local data network, i.e. the Internet, for example, or a global or local data connection, such as a Bluetooth connection, for example.

In a second step of the method, the audio-signal component AS.2 containing the main voice is extracted from the audio signal AS. The extraction serves to identify the audio-signal component AS.2 containing the at least one main voice within the audio signal AS and to separate out the audio-signal component AS.2 containing the main voice from the audio signal AS. The audio-signal component AS.2 containing the main voice is extracted by means of the extraction apparatus 8.

The audio-signal component AS.2 containing the main voice is extracted by splitting the audio signal AS into a plurality of audio-signal components AS.1-AS.3, one audio-signal component AS.2 obtained by splitting the audio signal AS containing the main voice. The audio signal AS is therefore split into a plurality of audio-signal components AS.1-AS.3, one audio-signal component AS.2 containing the at least one main voice. To do this, the audio signal AS can be analysed at least with respect to the audio-signal component AS.2 containing the main voice using analysis apparatuses or algorithms and is split accordingly. The analysis of the audio signal AS can be based on certain predefinable or predefined acoustic properties, i.e., for example, amplitude(s) and/or frequency/frequencies of audio-signal components AS.1-AS.3 containing main voices which are stored in a storage apparatus (data storage means) (not shown in the drawings), for example. The audio signal AS can therefore be analysed e.g. by comparing predefinable or predefined acoustic properties, i.e., for example, amplitude(s) and/or frequency/frequencies of audio-signal components containing main voices with the audio signal AS.

By splitting the audio signal AS, a centre audio-signal component AS.2 can be obtained, which typically contains the main voice. The audio signal AS is split into a plurality of audio-signal components AS.1-AS.3 by a hardware-implemented and/or software-implemented splitting apparatus 11 associated with or allocated to the extraction apparatus 8, which splitting apparatus is configured for splitting the audio signal AS into a plurality of audio-signal components AS.1-AS.3. The splitting apparatus 11 forms another functional component of the device 1.

The audio signal AS can be split by means of the splitting apparatus 11 into a centre audio-signal component AS.2, a left audio-signal component AS.1, which is in particular perceived by the listener to the left of the main voice or the centre audio-signal component AS.2, and a right audio-signal component AS.3, which is in particular perceived by the listener to the right of the main voice or the centre audio-signal component AS.2. The splitting of the audio signal AS carried out by means of suitable splitting apparatuses or algorithms can therefore provide (exactly) three audio-signal components AS.1-AS.3; therefore, the audio signal AS can be split into (exactly) three audio-signal components AS.1-AS.3, namely a left audio-signal component AS.1, which contains all or only components of the audio signal AS which are perceived to the left of the centre of the output or which are located to the left of the centre of the output, a right audio-signal component AS.3, which contains all or only components of the audio signal AS which are perceived to the right of the centre of the output or which are located to the right of the centre of the output, and a centre audio-signal component AS.2, which contains all or only components of the audio signal AS which are perceived in the centre of the output or which are located in the centre of the output.

The provided audio signal AS can be split into respective audio-signal components AS.1-AS.3 by means of a source-separation apparatus (not shown) that is associated with or allocated to the splitting apparatus. A corresponding source-separation apparatus can be implemented by a source-separation algorithm, for example. A suitable method for source separation or a suitable source-separation algorithm is described in German patent DE 10 2012 025 016 B3, for example.

In a third step of the method, the audio-signal component AS.2 containing the main voice obtained by extraction or splitting is attenuated. The audio-signal component AS.2 containing the main voice is attenuated in particular by reducing the dynamics or volume of the audio-signal component AS.2 containing the main voice. The audio-signal component AS.2 containing the main voice can also be completely blocked out by corresponding attenuating; the audio-signal component AS.2 containing the main voice can therefore be attenuated by the audio-signal component AS.2 containing the main voice being completely removed from the audio signal AS.

The audio-signal component AS.2, i.e. the centre audio-signal component AS.2, containing the main voice is attenuated by filtering the audio-signal component AS.2 by means of a hardware-implemented and/or software-implemented filter apparatus 12 that has an upper and a lower cut-off frequency and is associated with or allocated to the attenuating apparatus 9. The filter apparatus 12 may be designed as a stop filter apparatus, preferably a band-stop filter apparatus. The upper and the lower cut-off frequency of the filter apparatus 12 are selected such that frequency components of the main voice to be filtered out are filtered out.

Each audio-signal component AS.1-AS.3 obtained from splitting the audio signal AS can in principle, by means of the mixing apparatus 10, be mixed onto a particular audio-output channel 5, 6 of the audio-output apparatus 7 or output over a particular audio-output channel 5, 6 of the audio-output apparatus 7. The left and right audio-signal components AS.1, AS.3 are typically mixed onto the right and/or the left audio-output channel 5, 6 of the audio-output apparatus 7 in the context of outputting the audio signal by means of the mixing apparatus 10; typically, the left audio-signal component AS.1 is output over the left audio-output channel 5 and the right audio-signal component AS.3 is output over the right audio-output channel 6. It holds for the centre audio-signal component AS.2, which contains the main voice, that, depending on the degree of attenuation or blocking out, said component may be mixed onto or output over one or both audio-output channels 5, 6, e.g. so as to be split by component in an attenuated manner, or may not be mixed or output so as to be (completely) blocked out.

In a fourth step of the method, the audio signal AS is accordingly output over the left and the right audio-output channel 5, 6, wherein the audio-signal component AS.2 containing the main voice is accordingly output in an attenuated manner, or is not output because it has been blocked out.

The invention claimed is:

1. Method for outputting an audio signal that reproduces at least part of a piece of music containing at least one main voice into an interior forming part of a passenger compartment of a motor vehicle via an audio-output apparatus comprising a left and a right audio-output channel, the method comprising:

providing an audio signal that reproduces at least part of a piece of music containing at least one main voice, extracting an audio-signal component of the audio signal containing the at least one main voice from the audio signal, attenuating the audio-signal component containing the at least one main voice, outputting the audio signal over the left and the right audio-output channel of the audio-output apparatus, wherein the audio-signal component containing the at least one main voice is output in an attenuated manner, wherein before extracting the audio-signal component containing the at least one main voice, splitting the provided audio signal into a plurality of audio-signal components takes place, wherein one audio-signal component obtained by splitting the audio signal contains the at least one main voice.

2. Method according to claim 1, wherein the provided audio signal is split into a center audio-signal component, a left audio-signal component, which is perceived by the listener to the left of the main voice or the center audio-signal component, and a right audio-signal component, which is perceived by the listener to the right of the main voice or the center audio-signal component.

3. Method according to claim 2, wherein the center audio-signal component contains the at least one main voice.

4. Method according to claim 2, wherein the left audio-signal component is output over the left audio-output channel of the audio-output apparatus and the right audio-signal component is output over the right audio-output channel of the audio-output apparatus.

5. Method according to claim 1, wherein the provided audio signal is split into a plurality of audio-signal components by a source-separation apparatus.

6. Method according to claim 1, further comprising completely removing the audio-signal component containing the at least one main voice by applying a 100% attenuation.

7. Method according to claim 1, wherein the audio-signal component containing the at least one main voice is attenuated by the audio-signal component being filtered out of the audio signal by a filter apparatus.

8. Method according to claim 7, further comprising filtering the audio-signal component containing the at least one main voice out via a stop filter apparatus or a band-stop filter apparatus comprising an upper and a lower cut-off frequency, wherein the upper and the lower cut-off frequency of the filter apparatus are selected such that frequency components of the main voice to be filtered out are filtered out.

9. Method according to claim 1, wherein the audio signal is a stereo signal.

10. Device for outputting an audio signal that reproduces at least part of a piece of music containing at least one main voice into an interior forming part of a passenger compartment of a motor vehicle via an audio-output apparatus comprising a left and a right audio-output channel according to the method of claim 1, the device comprising:

an extraction apparatus, which is configured to extract an audio-signal component, containing the at least one main voice, of an audio signal reproducing a piece of music containing at least one main voice from the audio signal, an attenuating apparatus, which is configured to attenuate the audio-signal component containing the at least one main voice, an audio-output apparatus comprising two audio-output channels, which is configured to output the audio signal over the left and/or the right audio-output channel of the audio-output apparatus, wherein the audio-signal component of the audio signal containing the at least one main voice is output in an attenuated manner.

11. Device according to claim 10, wherein the extraction apparatus is configured for splitting an audio signal into a plurality of audio-signal components, wherein one audio-signal component obtained by splitting the audio signal contains the at least one main voice.

12. Device according to claim 10, wherein the attenuating apparatus is designed as or at least comprises a filter apparatus.

13. Device according to claim 12, wherein the filter apparatus comprises an upper and a lower cut-off frequency, wherein the upper and the lower cut-off frequency are selected such that frequency components of the main voice to be filtered out are filtered out.

14. Motor vehicle, comprising a device according to claim 10.

15. Method according to claim 1, wherein the at least one main voice is a singing voice.

16. Device of claim 10, wherein the at least one main voice is a singing voice.

* * * * *